US005114136A

United States Patent [19]

Miyoshi et al.

[11] Patent Number: 5,114,136

[45] Date of Patent: May 19, 1992

[54] DOCUMENT PUSHER PLATE OF AN IMAGE FORMING EQUIPMENT

[75] Inventors: Jun Miyoshi, Osaka; Mitsugu Shibanaka, Hyogo; Toshikazu Matsui; Nobukazu Ohtsuka, both of Osaka, all of Japan

[73] Assignee: Mita Industrial Co., Ltd., Osaka, Japan

[21] Appl. No.: 438,344

[22] Filed: Nov. 16, 1989

[30] Foreign Application Priority Data

Nov. 17, 1988 [JP] Japan ..... 63-292010

[51] Int. Cl.[5] ..... B65H 31/20

[52] U.S. Cl. ..... 271/213; 271/224; 271/273; 271/902

[58] Field of Search ..... 271/902, 186, 272-274, 271/224, 213

[56] References Cited

U.S. PATENT DOCUMENTS 4,579,326 4/1986 Pinckney ..... 271/902 X 4,699,365 10/1987 Smith ..... 271/902 X

*Primary Examiner*—Richard A. Schacher

*Attorney, Agent, or Firm*—Koda and Androlia

[57] ABSTRACT

The present invention relates to a document pusher plate to be used in an image forming equipment in which a document pusher plate which can be freely opened and closed by a hinge mechanism is mounted on a document set plate of the image forming equipment and a document is fed to the position of exposure on the document set plate or delivered from the position of exposure by rotating or reversing document transfer means arranged at the side of a document feeding device in the document pusher plate. This document pusher plate is provided with a reinforcement plate at the side of the document transfer means at the rear side thereof, and one end of the reinforcement plate is linked with the hinge mechanism, thereby causing warping or deflection of the document pusher plate to be prevented, accomplishing low cost of the production and light weight, and causing the document transfer to be accurate and stabilized by means of an automatic document feeding unit.

1 Claim, 6 Drawing Sheets

Fig. 3 (prior art)
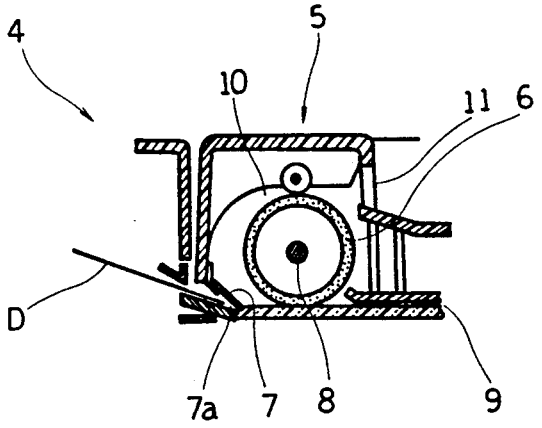
Fig. 4 (prior art) (a)
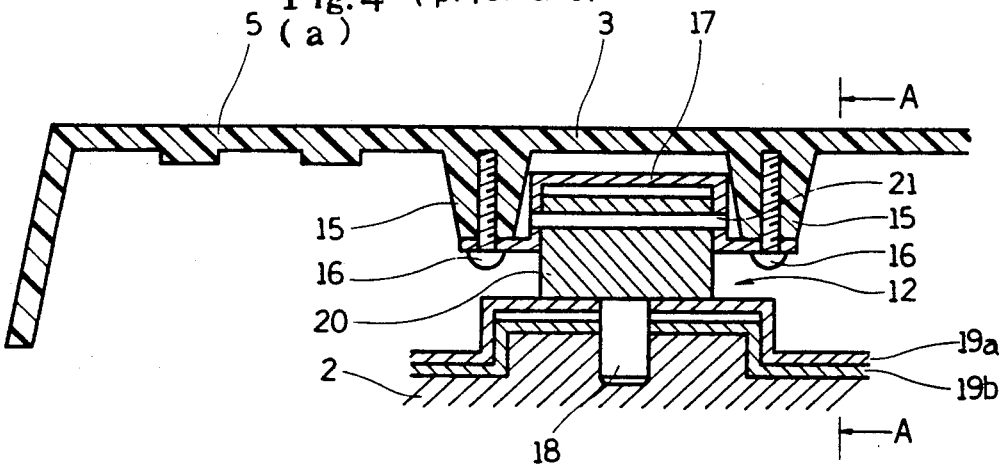
Fig. 4 (prior art) (b)
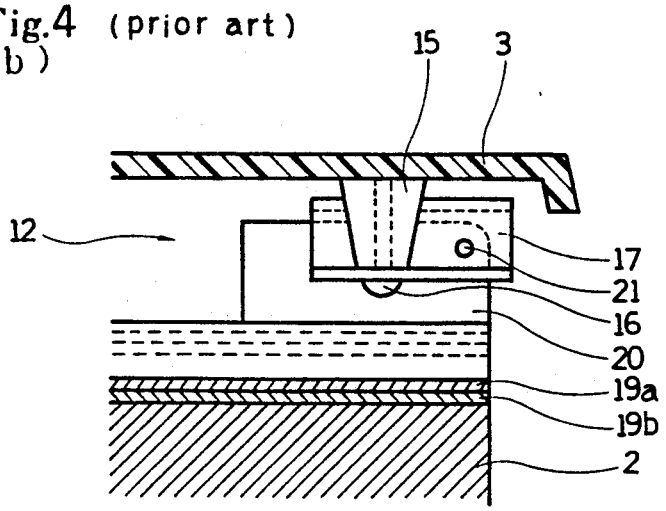

DOCUMENT PUSHER PLATE OF AN IMAGE FORMING EQUIPMENT

BACKGROUND OF THE INVENTION

1. Field of the invention

The present invention relates to a document pusher plate of an image forming equipment, by which document feeding and delivery can be smoothly carried out under a stabilized condition.

2. Description of the Prior Art

A document copying machine (Japanese Pat. Application No. Sho-63-61333) shown in FIG. 2 is available as a representative example of the conventional image forming equipments which are in the background of the invention. A document pusher plate 3 which can be freely opened and closed is mounted on the machine body 2 of the document copying machine 1 by means of a hinge mechanism. Such document transfer means (in this case, a document transfer roller) 6 of an automatic document feeding unit 5 as shown in FIG. 3 is arranged at the side of a document feeding device 4 of the document pusher plate 3.

Therefore, a document D which is fed from the document feeding device 4 to the automatic document feeding unit 5 pushes up a flexible thin plastic member 7 provided at a document feeding opening 7*a* and is sent to the document transfer roller 6.

Consecutively, as the document transfer roller 6 rotates counterclockwise in the drawing centering around an axis 8, the document D is transferred to the required exposure position on a document set plate 9. At this time, the document transfer roller 6 retains the document D between the document transfer roller 6 itself and the document set plate 9 at all times. Then, as copying job is completed, the above document transfer roller 6 rotates reversely, reverses the document D by 180° by way of the thin plastic member 7 and the delivery channel 10 and delivers it through a delivery port 11.

In such a conventional copying machine 1 as shown in the above, a hinge mechanism 12 shown in FIG. 4 is arranged at the side 13 of the document transfer roller 6 (FIG. 3) of the automatic document feeding unit 5 and at the opposite side 14 thereof. Thus, the resin-made document pusher plate 3 can be opened and closed by way of the hinge mechanism 12 for the machine body 2 of the document copying machine 1.

The above hinge mechanism consists of a mounting plate 17 formed to be trough-like and fixed to the side of the document pusher plate 3, a hinge body 20 fixed to the side of the machine body 2 of the document copying machine 1 by way of an axis 18 and mounting plates 19*a* and 19*b*, and an axis 21 arranged betweena the mounting plate 17 and the hinge body 20, by which the mounting plate 17 can be rotatably supported for the hinge body 20.

Hereupon, the document pusher plate 3 is a resin molded article for the sake of low cost and light weight, and the document pusher plate 3 itself constitutes a chassis and is not provided with any special reinforcement. In addition, as the mounting plate 17 of the hinge mechanism 12 is directly fixed to the protrusions 15 and 15 of the document pusher plate 3 by means of such fixing means 16 and 16 as screws, etc., the document pusher plate 3 is insufficiently supported. Moreover, as the document pusher plate 3 is made of resin as shown in the above, warping and deflection may be caused to be present through repeatedly opening and closing the document pusher plate 3 by way of the hinge mechanism 12. Subsequently, the force with which the document transfer roller 6 pushes a document especially at the side of the automatic document feeding unit 5 of the document pusher plate 3 may get into imbalance in the axial direction, thereby causing documents not to be transferred accurately and to be skewed in transfer.

Therefore, it is an object of the present invention to provide an image forming equipment in which document can be accurately transferred by an automatic document feeding unit under a stabilized condition.

SUMMARY OF THE INVENTION

In order to accomplish the above object of the invention, an image forming equipment in which a document pusher plate that can be freely opened and closed by means of a hinge mechanism 12 is mounted on the upper portion of the document set plate of the image forming equipment proper and a document is fed to the position of exposure on the document set plate and is delivered from the position of exposure by rotating or reversing the document transfer means arranged at the side of the document feeding device in the document pusher plate comprises a reinforcement plate mounted at the side of document transfer means at the rear side of the document pusher plate and is characterized in that one end portion of the reinforcement plate is linked with the hinge mechanism.

Therefore, according to the invention, a reinforcement plate is mounted at the side of the document transfer means at the rear side of the document pusher plate, and furthermore one end portion of the reinforcement plate is linked with the hinge mechanism, thereby causing the document pusher plate not to be directly linked with the hinge mechanism, force given to the hinge mechanism by opening and closing of the document pusher plate to be transmitted only to the reinforcement plate, and warping or deflection not to be produced on the document pusher plate.

For this reason, the document transfer means arranged in the automatic document feeding unit of the document pusher plate can push a document with uniform force in the axial direction at all times, thereby causing the documents to be accurately transferred.

This specification of the present invention specifically points out the subject thereof and is complete with the claims clearly claimed. The above, and other objects, features and advantages of the present invention, will become apparent from the following description taken in conjunction with the accompanying drawings.

BRIEF DESCRIPTION OF THE DRAWINGS

FIG. 3 is an enlarged sectional view of the automatic document feeding unit of the conventional image forming equipment which is in the background of the invention, FIG. 4*a* is a partially enlarged sectional view showing the vicinity of the hinge mechanism at the side of document transfer means in FIG. 2, FIG. 4*b* is a sectional view cut off along with the line A—A in FIG. 4*a*.

DETAILED DESCRIPTION OF THE PREFERRED EMBODIMENTS

Figure 2:
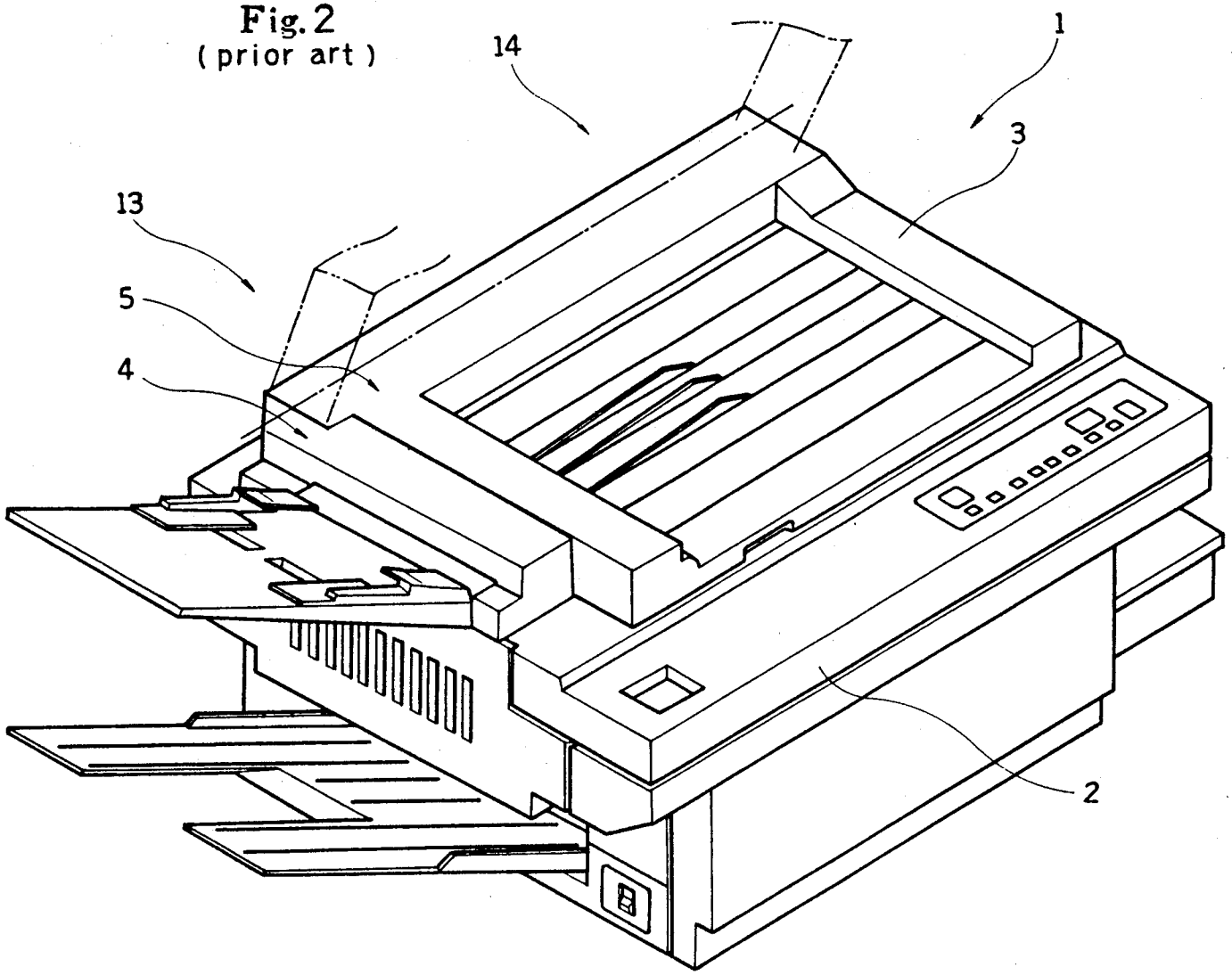
Fig. 2 (prior art)
FIG. 2 is a perspective view of a document copying machine as one representative example of the conventional image forming equipment which is in the background of the invention.

In the following description, the same reference numbers or symbols are given to the elements which are common to a conventional image forming equipment 1 (the description hereunder is made with reference to a document copying machine as representative example) shown in FIG. 2 through FIG. 4.

Figure 1:
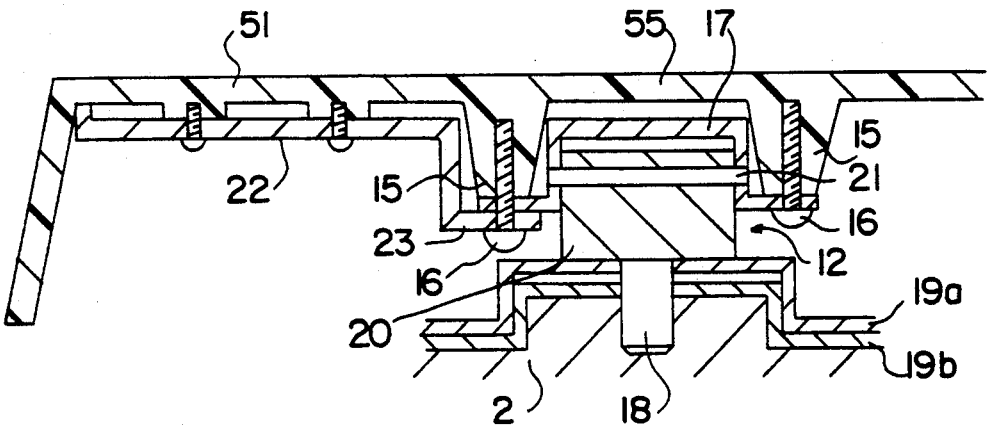
FIG. 1 is a partially enlarged sectional view showing the vicinity of the hinge mechanism at the side of the document transfer means in one of the preferred embodiments of the invention which is shown in FIG. 5.

In this embodiment, the point which is different from those in the conventional image forming equipment 1 is such that as shown in FIG. 1, a reinforcement plate 22 is mounted along with the side of the document transfer roller 6 at the rear side of the document pusher plate 3 and one end portion 23 thereof is linked with the hinge mechanism 12.

Therefore, in the case that the document pusher plate 3 is opened or closed for the image forming equipment proper, firstly, the reinforcement plate 22 fixed in a body to the document pusher plate 3 by means of screw means 16 rotates, centering around the hinge mechanism 12 when lifting up the document pusher plate 3, and the mounting plate 17 of the hinge mechanism 12 rotates centering around the axis 21 of the hinge mechanism 12, thereby causing the document pusher plate to be opened. Therefore, force given to the hinge mechanism 12 is given to only the reinforcement plate 22, but the force is not given to the document pusher plate 3 which is composed together with the reinforcement plate 22 in a body.

On the contrary, in the case that the document pusher plate 3 is closed, the mounting plate 17 of the hinge mechanism rotates in the reverse direction of the above rotation, centering around the axis 21 of the hinge mechanism 12, conversely of the case that the reinforcement plate 22 is opened, when the document pusher plate 3 is pushed downwards. Thereby the document pusher plate 3 is caused to be closed.

Also, the reinforcement plate 22 may be tightened to the document pusher plate 3 together with the hinge mechanism 12 as component separate from the mounting plate 17 of the hinge mechanism 12 as shown in FIG. 1 or may be composed in a body together with the mounting plate 17 of the hinge mechanism 12.

Figure 9:
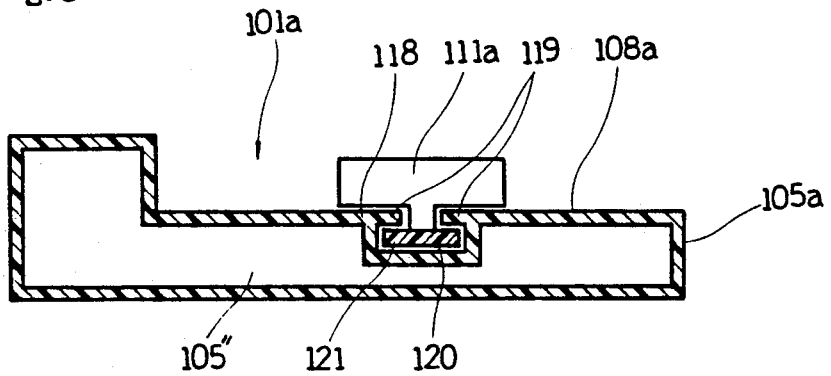
Fig. 9 (prior art)
FIG. 9 is a sectional view of a conventional automatic document feeding unit by which the invention is effected.
Figure 10:
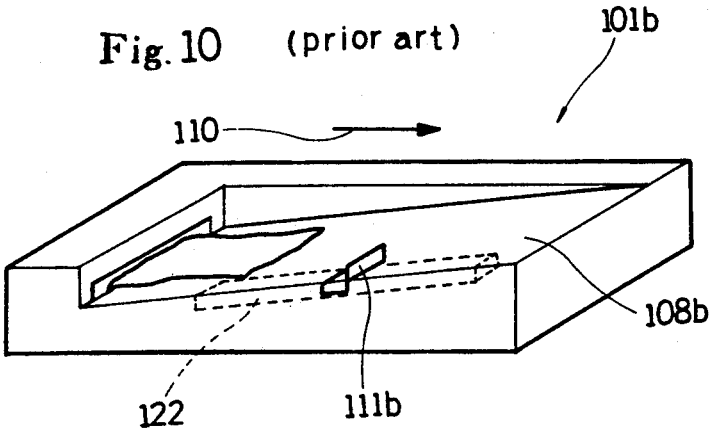
Fig. 10 (prior art)
FIG. 10 is a perspective view of another automatic document feeding unit.

FIGS. 9 and 10 show the outline of an automatic document feeding unit 101*a* and 101*b* to which the invention can be effected. As the sectional view of one of the automatic document feeding unit 101*a* is shown in FIG. 9, a document receiving portion 108*a* in which an image formed document is delivered is formed to be plain on the upper portion of the document pusher plate 105*a* internally provided with a document transfer portion 105″, and on the upper part of said document receiving portion, means for stopping the delivered document is provided.

In this embodiment example, the means for stopping comprises a guide groove 120 which are formed lengthwise in the direction of delivery downwards on the surface of the document receiving portion 108*a* and the guide groove has stopping protrusions 119 on each edge 118 for the surface of the document receiving portion 108*a*, respectively, and a document stopper 111*a* whose leg portion 121 is protruded downwards and is slidable in the direction of delivery so that it can not slip off from the guide groove 120 and which are formed to be long with the right angle to the direction of delivery.

As the document stopper 111*a* can easily slide in the direction of delivery on said automatic document feeding means 101*a*, the document stopper 111*a* can be applicable to various sizes of delivered documents. In addition, when opening and closing the document pusher plate 105*a*, the document stopper 111*a* does not slip off.

Next, as shown in FIG. 10, in the other example of the embodiment of the invention, stopping means of delivered documents of automatic document feeding unit 111*b* comprises a magnet 122 internally built in to be long on the rear side of the document receiving portion 108*b* in the direction of delivery (the direction of an arrow 110) and a document stopper 111*b* which is slidably mounted on the upper surface of the document receiving portion 108*b* in the direction of delivery by means of magnetic force of the magnet 122.

In this embodiment, as well as the above example of the embodiment, it is very easy to slide the document stopper 111*b*, and the document stopper 111*b* can not easily come off as using a magnet 122. However, it is removable if the necessity occurs. So, it is convenient, too.

Actually however, in the automatic document feeding unit so composed as shown in the above, as the document stopper with which delivered documents are brought into contact and stop thereto is caused to slide, guide grooves formed downwards from the upper surface of the document receiving portio formed at the upper surface of the document pusher plate and a magnet internally built in on the rear side of the document receiving portion have been utilized. For this reason, the composition may become complicated, and space occupied by the guide grooves and the guide portion has been needed at the lower part of the document receiving portion.

Besides, there is a still another problem if a magnet is used. Namely, the cost of material is increased and the material of the document stopper is limited to magnetic materials.

Furthermore, in the stopping means of said automatic document feeding unit shown in the above, as the document stopper slides in the direction of delivery, the document receiving portion is to be plain due to the structure of the guide portion. Therefore, as the surface with which a document delivered to the document receiving portion is brought into contact is plain, there is another inconvenience, that is, it is difficult to collect the documents.

Hereupon, the document pusher plate and the document stopper which are shown in FIGS. 5 to 10 have been invented.

Figure 5:
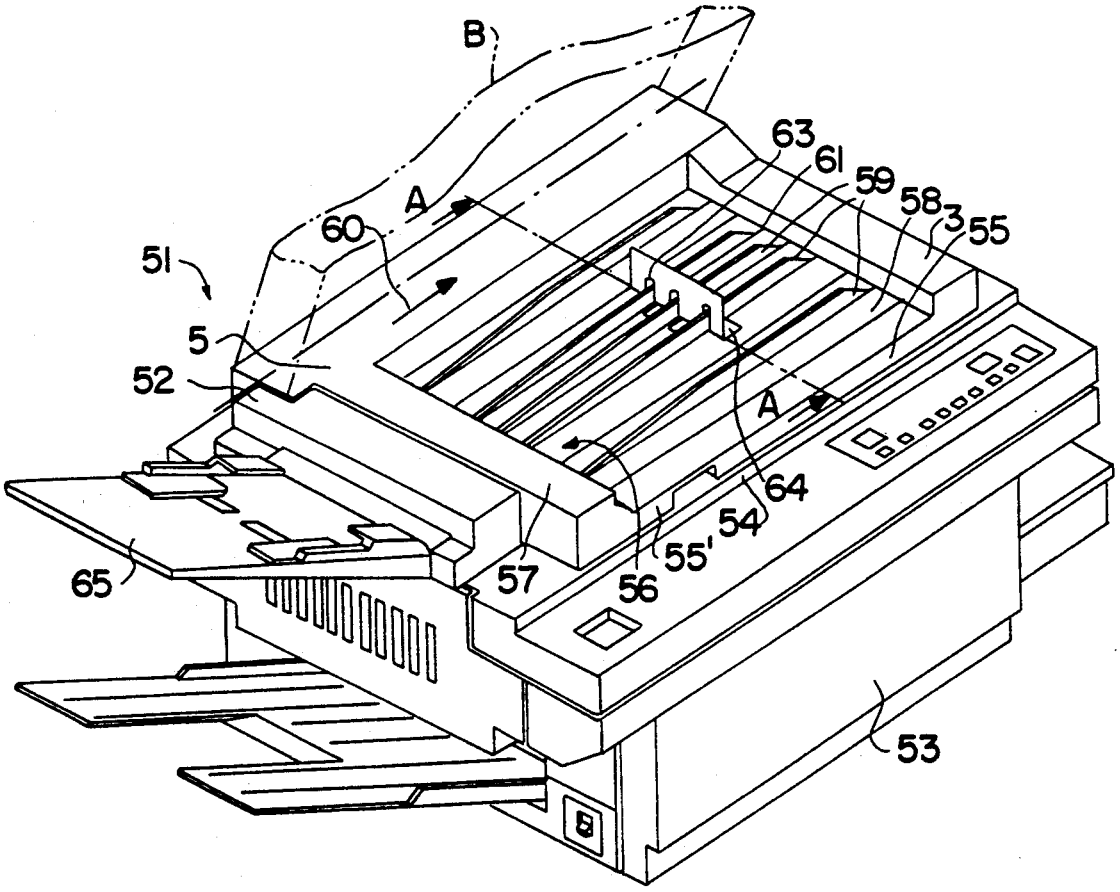
FIG. 5 is a rough perspective view of an automatic document feeding unit by which the invention is effected and an image forming equipment in which the automatic document feeding unit is mounted.
Figure 6:
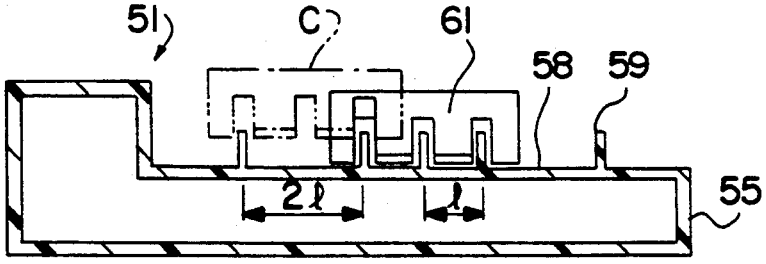
FIG. 6 is a sectional view cut off along with the line A—A of the automatic document feeding unit in FIG. 5.
Figure 7:
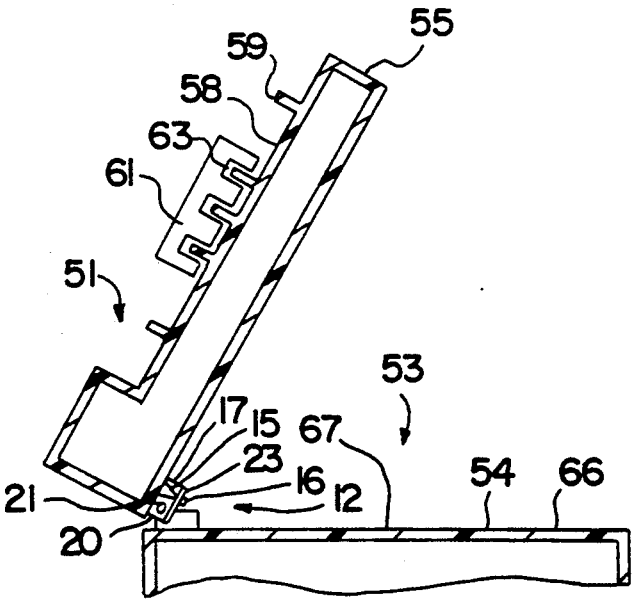
FIG. 7 is a sectional view along the line A—A in FIG. 5 for explaining the states of the automatic document feeding unit with the document pusher plate opened.

An automatic document feeding unit 51 shown in FIGS. 5 to 7 comprises;

a document supplying portion 52 to supply a document for image forming processing, a document transfer portion 55', which is built in a document pusher plate 55 installed above the document set plate 54 of the image forming device 53, for transferring a document fed from the document supplying portion 52 to the position of exposure on a document set plate 54 at the body side of an image forming device 53 and for delivering the document after exposure, a delivery portion 57 composed integrally with the document pusher plate 55, whose delivery port 56 is so formed as to be an opening for delivering an image formed document toward the upper surface of the document pusher plate 55, and A document receiving portion 58 formed adjacent to the above delivery port 56 on the document pusher plate 55 for piling the image formed documents.

In this embodiment, a plurality of ribs 59 are formed to be long in the direction of delivery (the direction of an arrow 60) so that they can be upwardly protruded vertically on the plain of the document receiving portion 58. At this time, the plurality of ribs 59 are formed with a required interval therebetween to the right angle in the direction of delivery.

Furthermore, the document stopper 61 with which a document delivered from the delivery port 56 is brought into contact and stops thereto is placed on said document receiving portion 58 with its lenghtwise side at the right angle with the direction of delivery.

In the document stopper 61 as shown in FIGS. 5 through 8, notches 63 so formed upwardly from the edge 62 of the document stopper to be plural with the appointed interval that it can be longer than the height of the ribs 59, wider than the width in the direction of the right angle to the direction of delivery of the ribs 59 and slidable for the ribs 59 and that when the document pusher plate 55 is opened (Two-dotted line B in FIG. 5 and in FIG. 7) the document stopper can be fixed on the ribs 59, and leg portions 64 formed to be parallel on the plane of the document receiving portion 58 at the edge portions 62 where the above notches 63 are not formed.

Here, the above appointed interval is the interval between the adjacent notches of the document stopper 61. In other words, in the case that a unit interval is supposed to be "l", the appointed interval is "l" or the integral number of times of "l". Namely, in the case that the number of notches formed in the document stopper 61 is "n", the interval to the direction of the right angle to the direction of delivery of the adjacent ribs 59 may be $(n-1)\times l$. However, in the case that the number of the notch 63 in the document stopper 61 is one $(n=1)$, the interval between the adjacent ribs 59 is not limited if the document stopper 61 is housed between the ribs 59.

Figure 8:
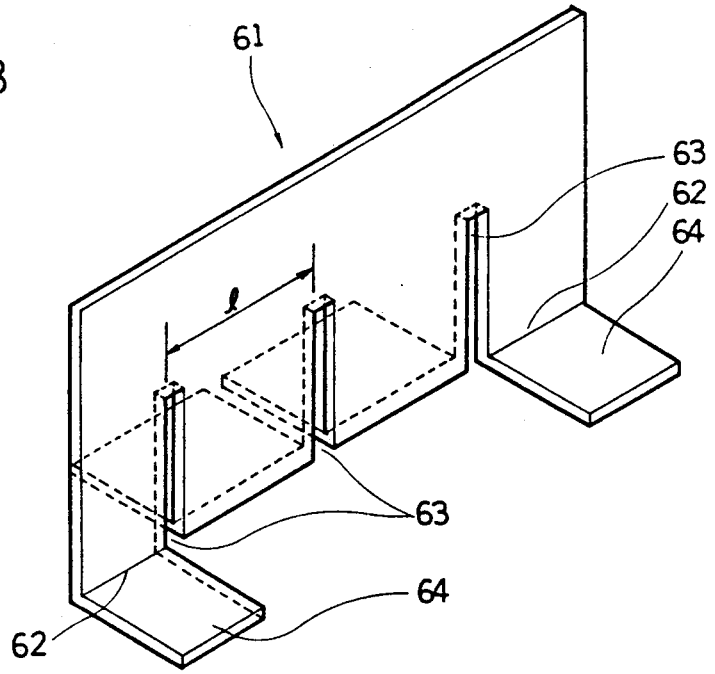
FIG. 8 is a perspective view of a document stopper.

In this example of the embodiments of the invention, as shown in FIGS. 6 through 8, as the number of notches 63 of the document stopper 61 is three, the interval between the adjacent ribs 59 may be 2l. Thereby, the number of the above ribs 59 may be omitted.

In an automatic document feeding unit 51 according to the above embodiment, a document set on the document tray 65 attached to the document feeding portion 52 which is about to be image-formed is fed to the document transfer portion 55' built in the document pusher plate 55 by document feeding means (not illustrated) of the document feeding portion 52.

Next, the document is transferred to the position of exposure between the document pusher plate 55 and the document set plate 54 at the body side of the image forming device 53 by transfer means (not illustrated) of the document transfer portion 55'. And a document for which image forming processing like exposure, etc. has been completed is transferred to the delivery portion 57 integrally formed in a body on the upper surface of the document pusher plate 55.

Consecutively, the document is delivered from the delivery port 56 to the document receiving portion 58 provided on the upper surface of the document pusher plate 55. The delivery port 56 is formed to be opened toward the downstream in the direction of delivery at the side in the direction of the right angle to the direction of delivery of the delivery portion 57.

At this time, as mentioned above, a plurality of ribs 59 are formed on the document receiving portion 58. Furthermore, the document stopper 61 at which the notches 63 are set over the ribs 59 thereof and the leg portions 64 thereof are placed on the upper surface of the document receiving portion 58 is set to the position in the direction of delivery according to the size of document to be delivered onto the document receiving portion 58 with its lengthwise direction thereof at the right angle with the direction of delivery.

Therefore, the document delivered from the delivery port 56 is brought into contact with the document stopper 61 to stop there, and the document is piled on the ribs 59.

For this reason, as clearance equivalent to the height of the ribs 59 is produced between the document piled in the above and the document receiving portion 58, it is very easy for an operator to collect the documents from the document receiving portion 58.

Besides, in the case that the position of exposure of the document is biased toward the opening 66 of the document pusher plate 55 or to the corner portion of the hinge side 67 on the plane of the document set plate 54 (corner alignment case), the document is delivered on the position different from the central portion in the direction of delivery of the document receiving portion 58. In an image forming equipment like this type, the document stopper 61 can slide in the direction of the right angle to the direction of delivery, so that the documents may not be skewed on being piled after the documents are brought into contact with the document stopper 61.

Namely, FIG. 6 shows an example (shown with the two-dotted line "C") in which the document stopper 61 placed at the central portion in the direction of the right angle to the direction of delivery of the document receiving portion 58 slides to the side of the hinge 67 of the document pusher plate 55.

Thus, as the document stopper 61 can be detachably set at an adequate position on the upper surface of the document receiving portion 58, it is very easy to conform to changes of the size of documents or the position of delivery of the delivery port 56.

The invention can be effected and/or carried out in other embodiments without departing from the spirits and substantial features thereof.

Therefore, though the above embodiment is one of the preferred embodiments, the invention is not limited only to the embodiment mentioned in the above.

An it can be easily understood that all the modifications which can be effected in the scope of the claims described hereinafter and the scope meant by the claims are included in the claims hereof.

What is claimed is:

1. An image forming equiment in which a document pusher plate that can be freely opened and closed by means of a hinge mechanism is mounted on the upper portion of the document set plate of the image forming equipment proper and a document is fed to the position of exposure on a document set plate and delivered from the position of exposure by a document transfer means arranged at the side of a document feeding device and the document pusher plate is characterized in that a reinforcement plate is attached to the side of the document transfer means at the rear side of the document pusher plate and one end of the reinforcement plate is linked with the hinge mechanism.

* * * * *